United States Patent [19]

Buckner

[11] Patent Number: 4,486,137

[45] Date of Patent: Dec. 4, 1984

[54] PIPE PICKUP AND LAYDOWN MACHINE

[75] Inventor: James E. Buckner, Lafayette, La.

[73] Assignee: Ingram Corporation, New Orleans, La.

[21] Appl. No.: 406,627

[22] Filed: Aug. 9, 1982

[51] Int. Cl.[3] ..... E21B 19/14

[52] U.S. Cl. ..... 414/22; 180/89.14; 280/43.23; 280/43.24; 414/748

[58] Field of Search ..... 414/22, 745, 748; 175/52, 85, 219; 180/89.14, 327, 328; 212/182, 206; 296/190; 280/43.23, 43.24, 43.14; 193/17

[56] References Cited

U.S. PATENT DOCUMENTS

| | | | |
|---|---|---|---|
| 857,784 | 6/1907 | Bisset | 193/17 |
| 2,335,719 | 11/1943 | Williams | 414/22 |
| 2,877,981 | 3/1959 | McMurry | 280/43.24 X |
| 3,169,645 | 2/1965 | Freeman | 414/22 |
| 3,737,192 | 6/1973 | Hirsch | 296/190 |
| 4,051,956 | 10/1977 | Teague | 414/22 X |
| 4,371,302 | 2/1983 | Frias et al. | 414/22 |

OTHER PUBLICATIONS

International Publication Number WO82/00853, Ingram Corporation, Mar. 18, 1982.

*Primary Examiner*—Leslie J. Paperner

*Attorney, Agent, or Firm*—Lalos, Leeds, Keegan, Lett, Marsh, Bentzen & Kaye

[57] ABSTRACT

A machine for transferring pipe between the floor of a drilling rig and a pipe rack including a stationary trough positioned below the drilling rig floor and a movable trough aligned with the stationary trough and having one end resting on the drilling rig floor and the other end movable vertically relative to the end of the stationary trough nearest the drilling rig. An operator's cab is attached to and supported by the end of the stationary trough distant the drilling rig floor. The cab has a housing which is pivotally attached at its forward edge to the stationary trough whereby the housing may be pivoted forward 90° onto the stationary trough for ease of transporting the machine. The operator's cab further includes a control panel mounted to the stationary trough and not pivotal with the housing. A lifting device attached underneath the stationary trough can cam the stationary trough up off of its support surface until it rests on rollers. The machine may then be pulled or pushed along the catwalk or a flatbed on these rollers. Guide arms attached to the lifting device guide the stationary trough along the catwalk. Racking arms attached to the sides of the stationary trough move the pipe laterally between the stationary trough and the pipe racks. An adjustable pipe run-off assembly attached to the stationary trough adjacent the racking arms allows the pipe to be guided away from the racking arms to different positions on the pipe rack. The racking arms are adjustable in length and have a pivotal support plate secured at their end.

14 Claims, 16 Drawing Figures

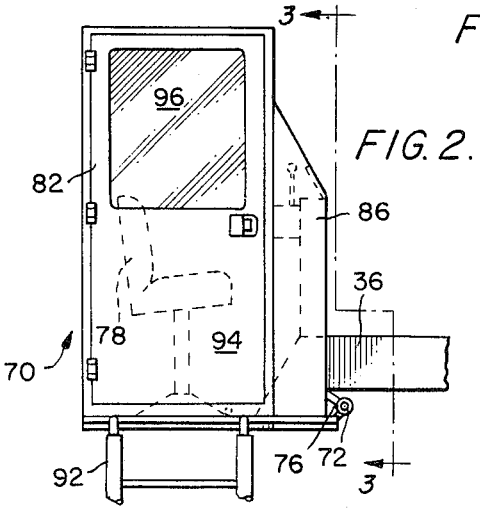
FIG. 2.
FIG. 3.
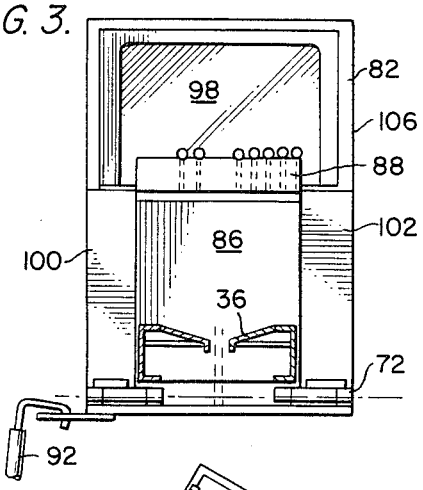
FIG. 4.
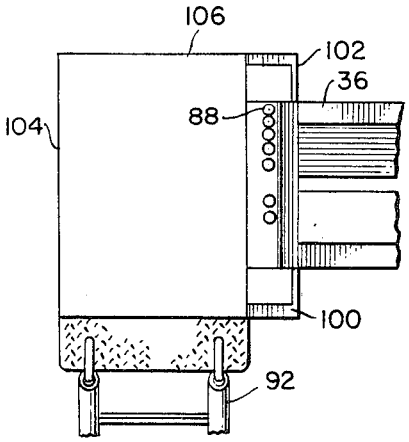
FIG. 5.
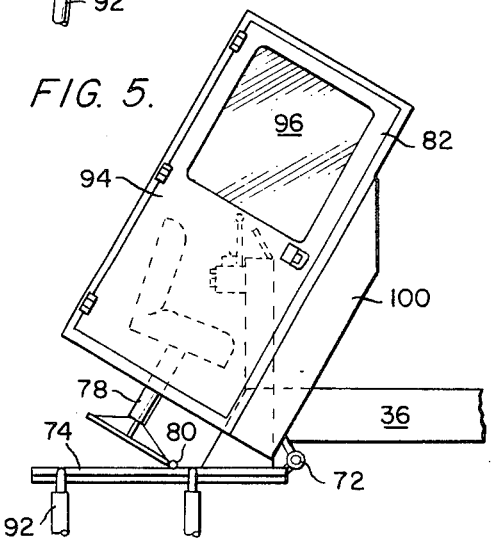
FIG. 6.
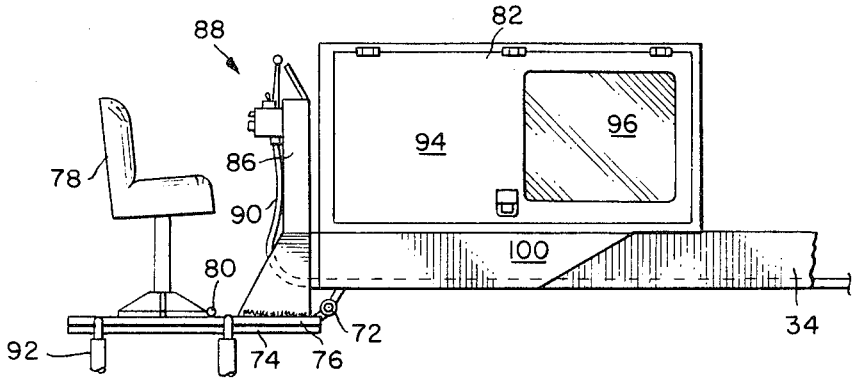

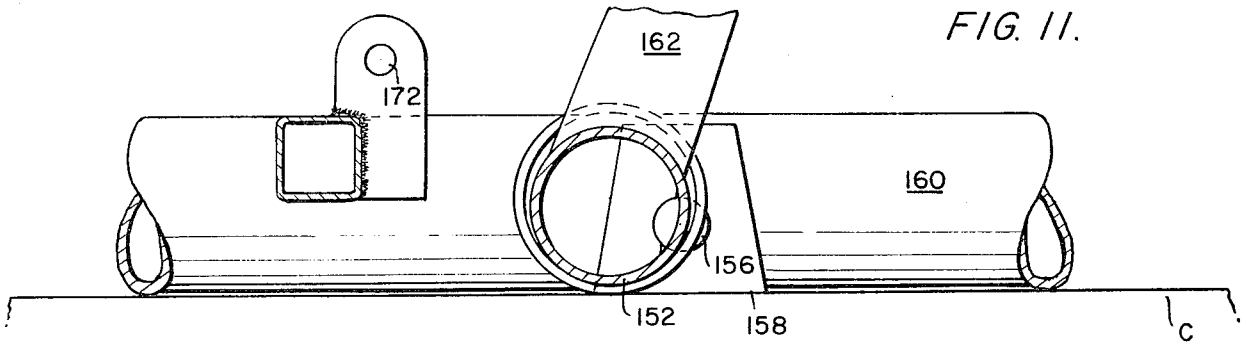
FIG. 11.
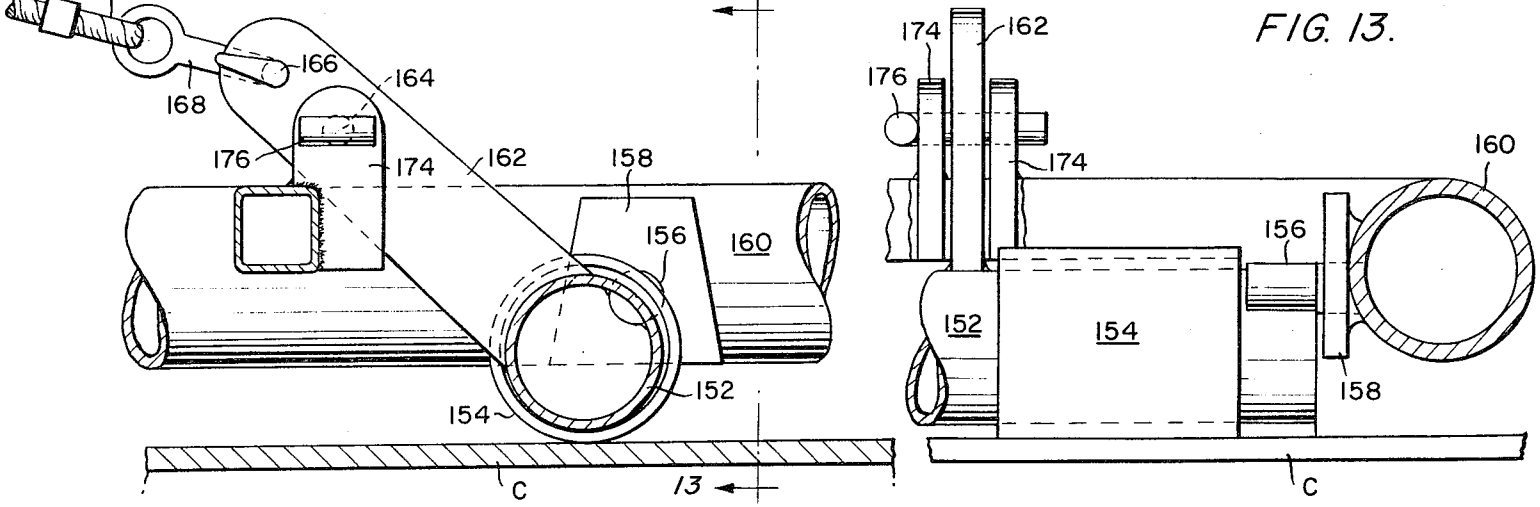
FIG. 12.
FIG. 13.

62
56
54
196
194
190
192
188
187
182
34
32
C
P
R
180
198
200
202
184
16
64
60
208
210
212
214
216
218
220
222
224
204
206
S

PIPE PICKUP AND LAYDOWN MACHINE

BACKGROUND OF THE INVENTION

This invention relates to a machine for handling pipe and other similar goods between a drilling rig and a pipe rack. It relates more particularly to a pipe handling machine adapted for use at onshore locations as well as to a machine that can be easily disassembled, transported between drilling rig sites, and reassembled at the new site.

This invention is an improvement over commonly assigned U.S. applications Ser. No. 192,495, filed Sept. 30, 1980, now U.S. Pat. No. 4,371,302, and Ser. No. 328,252, filed Dec. 7, 1981, now U.S. Pat. No. 4,453,872, and these applications are hereby incorporated by reference in their entirety. Generally, the pipe handling machines disclosed in the above-incorporated applications include a stationary trough resting on a frame which is positioned on a catwalk. A cab for the operator's station is mounted at one end of the trough and a pair of masts at the other end. A movable trough has one end supported on the drilling rig floor and the other end adapted to be moved between the masts. A carriage means slides the pipe along the stationary trough and between the stationary and movable troughs. The stationary trough further has a tiltable dump trough portion at a middle portion thereof which moves the pipe laterally between the stationary trough and the racking arms attached to the sides of the stationary trough. Powered lug means moving along the racking arms move horizontal lengths of pipe between the dump trough and the pipe racks positioned adjacent to the stationary trough. Thus, the pipe can be automatically cycled between pipe racks and an elevated drilling rig floor.

It is desirable that these machines be easily assembled, disassembled and transported between drilling rig sites. Difficulties have been encountered in moving these heavy machines onto and off of the catwalks. Sometimes in the past, cranes would have to be brought in and used to move the machine or the machine would have to be dragged across the catwalk which could damage the machine, the catwalk, or both. Difficulties were also encountered in keeping the elongated machine aligned on the catwalk as it was being dragged along it.

The cab or operator's station mounted at the end of the stationary trough away from the drilling rig would have to be either completely disassembled or unbolted and physically moved off of the stationary trough requiring valuable time and equipment when the machine was to be moved. Also, if the control panel positioned in the cab were to be folded onto the stationary trough it would have to include flexible hydraulic hoses which would often break or become entangled.

The racking arms, as fully disclosed in the prior applications, comprise a pair of parallel elongated arms connected at their upper ends to the stationary trough and having lower ends resting on a surface adjacent the pipe racks. These fixed-length arms cannot accommodate varying heights of catwalks. The old systems also did not provide any means for efficiently loading the pipe onto various levels of a pipe rack, nor did they allow for the placement of pipe on a pipe rack positioned a distance from the pipe racking arms.

OBJECTS OF THE INVENTION

Accordingly, it is the principal object of the present invention to provide an improved and novel machine for transferring pipe between a pipe rack and the floor of a drilling rig.

Another object of the present invention is to provide a pipe transferring machine which can be readily moved to and from a flatbed truck and a catwalk without requiring a crane or similar hoisting machinery.

A further object of the present invention is to provide a pipe transferring machine which can be compactly folded into an easily transportable mode.

A still further object of the present invention is to provide an operator's cab mounted on the machine which can be pivoted onto the machine to a compact folded position and which does not require the use of flexible hydraulic control hoses.

Another object is to provide a pipe transferring machine which can be easily lifted off of a surface, for example a flatbed truck or a catwalk, and rolled along that surface without damaging the surface or the machine.

A further object is to provide a pipe transferring machine which can be readily rolled along a catwalk without falling off of that catwalk.

A still further object is to provide a pipe transferring machine which can place pipe at different locations on a pipe rack positioned adjacent the machine.

Another object is to provide a pipe transferring machine which can be adjusted for different pipe racks and for different pipe placement on the racks as pipe is stacked on them.

A further object is to provide a pipe transferring machine which has pipe racking arms attached thereto which can be adjusted in their lengths to adapt to different catwalk heights.

A still further object is to provide a pipe transferring machine which has pipe racking arms that rest firmly on the support surface for different angles of contact.

Other objects and advantages of the present invention will become more apparent to those persons having ordinary skill in the art to which the present invention pertains from the foregoing description taken in conjunction with the accompanying drawings.

THE DRAWINGS

FIG. 2 is a fragmentary, side view of the operator's cab of FIG. 1.

FIG. 3 is a rear elevational view of the operator's cab of FIG. 2.

FIG. 4 is a top plan view of the operator's cab of FIG. 2.

FIG. 5 is a view similar to FIG. 2 illustrating the operator's cab in a partially folded position.

FIG. 6 is a view similar to FIG. 2 illustrating the operator's cab in a folded, transportable position.

FIG. 11 is a side elevational view of a second embodiment of the frame roller of the present invention.

FIG. 12 is a view similar to FIG. 11 illustrating the frame roller in a lifted position.

FIG. 13 is a cross-sectional view taken along line 13—13 of FIG. 12.

DESCRIPTION OF THE INVENTION

General Description

Figure 1:
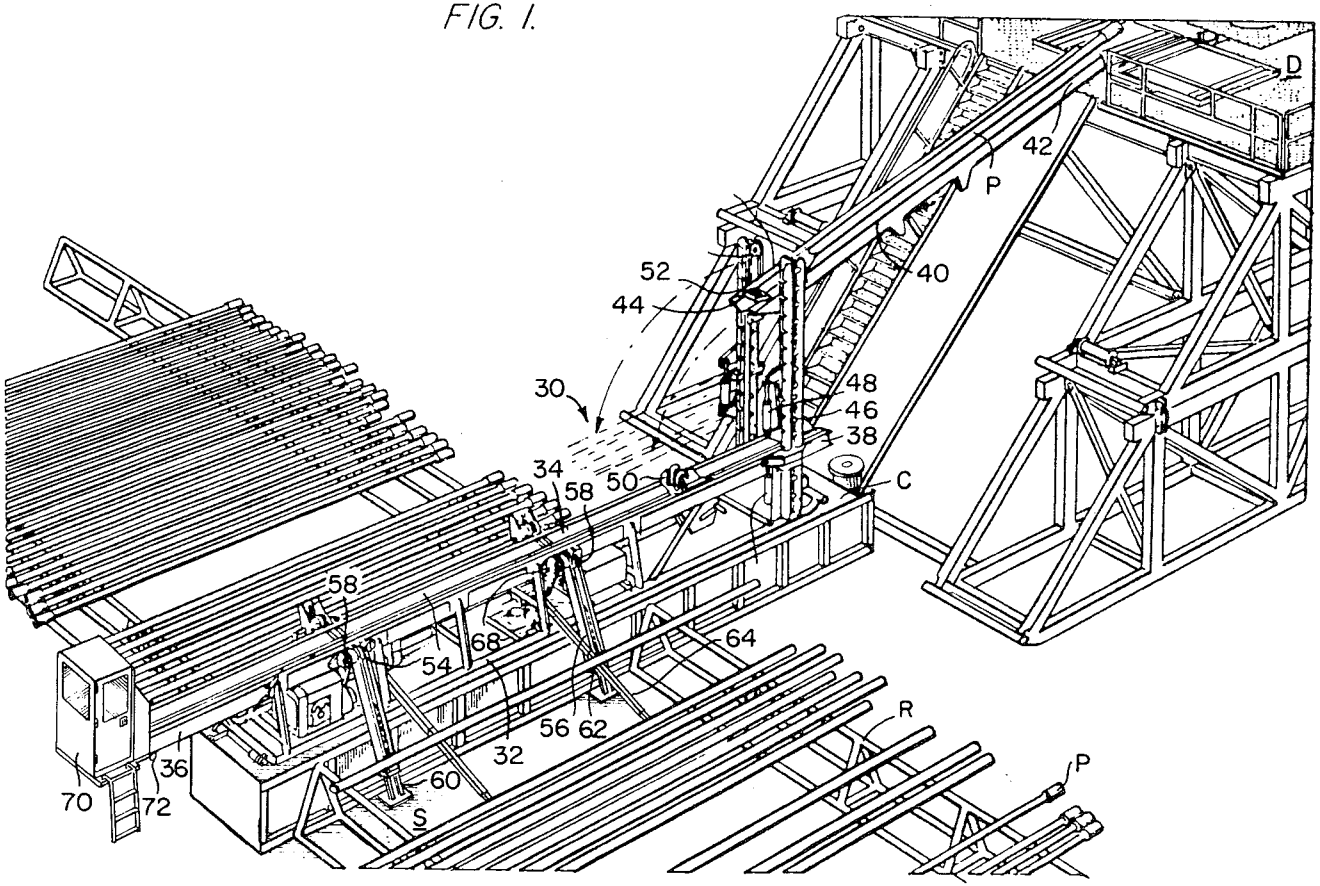
FIG. 1 is a perspective view of a machine embodying the present invention in use at a drilling rig site.

Referring to FIG. 1, there is illustrated a machine embodying the present invention shown generally at 30 for handling pipe P and other tubulars. This machine generally includes a support frame 32 shown positioned on a catwalk C, a stationary trough 34 having ends 36 and 38 resting on and supported by support frame 32, and a movable trough 40 supported at one end 42 on drilling rig D and at its other end 44 by a pair of masts 46. Masts 46 are mounted on opposite sides of stationary trough end 38 and a mast drive system shown generally at 48 lifts and lowers movable trough end 44 between the masts. As movable trough end 44 is raised to its upper position, movable trough end 42 is caused to slide further onto the floor of drilling rig D and to be positioned generally lower relative to the floor whereby a length of pipe P may be more easily removed from movable trough 40. When movable trough end 44 is in its lower position, movable trough 40 and stationary trough 34 are adjacent and in alignment so that pipe P can easily slide between them.

The present invention also provides for a buggy 50 which is powered to ride in stationary trough 34 between ends 36 and 38 thereof moving pipe P with it and between stationary trough 34 and movable trough 40. Similarily, a carriage 52 can be positioned to ride in movable trough 40 moving pipe along its length.

Stationary trough 34 has a pivoting dump trough portion shown generally at 54 which can be lifted and tilted from side to side so that pipe may be moved laterally to and from stationary trough 34. Pipe racking arms shown generally at 56 are attached at their upper ends 58 to frame 32 and rest at their lower ends 60 on support surface S. Lugs 62 are powered to move together along arms 56 to cradle and move pipe along the arms between pipe racks R and stationary trough 34. Run-off assemblies 64 are attached at one end to the frame and are held by chain means, described fully later, in an angled position towards the pipe racks R so that pipe P rolls from lugs 62 travelling down arms 56 and out toward pipe racks R.

A frame roller mechanism shown generally at 68 can lift and roll machine 30 along catwalk C or along the flatbed of a truck. The operator's cab 70 is attached at end 36 of stationary trough 34 by a hinge assembly shown generally at 72, which allows cab 70 to be pivoted forward so that it rests on stationary trough 34 for easier transport.

Detailed Description

Referring to FIGS. 2 through 6, operator's cab 70 is illustrated in greater detail. It comprises essentially a pipe and pin hinge assembly at 72 firmly attached to the underneath portion of stationary trough end 36 and to platform 74 along its forward edge 76. Operator's chair 78 is attached to platform 74 and is pivotally mounted at its forward edge 80, as best shown in FIG. 5, so that it can tilt forward out of the way as housing 82 is pivoted forward about hinge assembly 72. Control panel 86 is mounted to platform 74 adjacent stationary trough end 36. Panel 86 includes controls shown generally at 88 and connection hoses 90 which may be formed of a non-flexible material, for example, copper or the like. A ladder 92 is removably attached to a side of platform 74. Housing 82 has a side door 94 including a window 96. The front portion of housing 82 includes an upper windshield 98 and two side panels 100 and 102. Side panels 100 and 102, as best shown in FIG. 3, are disposed on opposite sides of stationary trough 34 and, when the housing is pivoted forward onto the stationary trough, they are positioned on opposite sides thereof, as best shown in FIG. 6. Housing 82 also has walls 104 in the rear and 106 on the opposite side, and they may also be provided with suitable windshields. It is also within the scope of the present invention to include removable windshields for removal during transport of machine 30 and for ease in replacement if broken.

Figure 7:
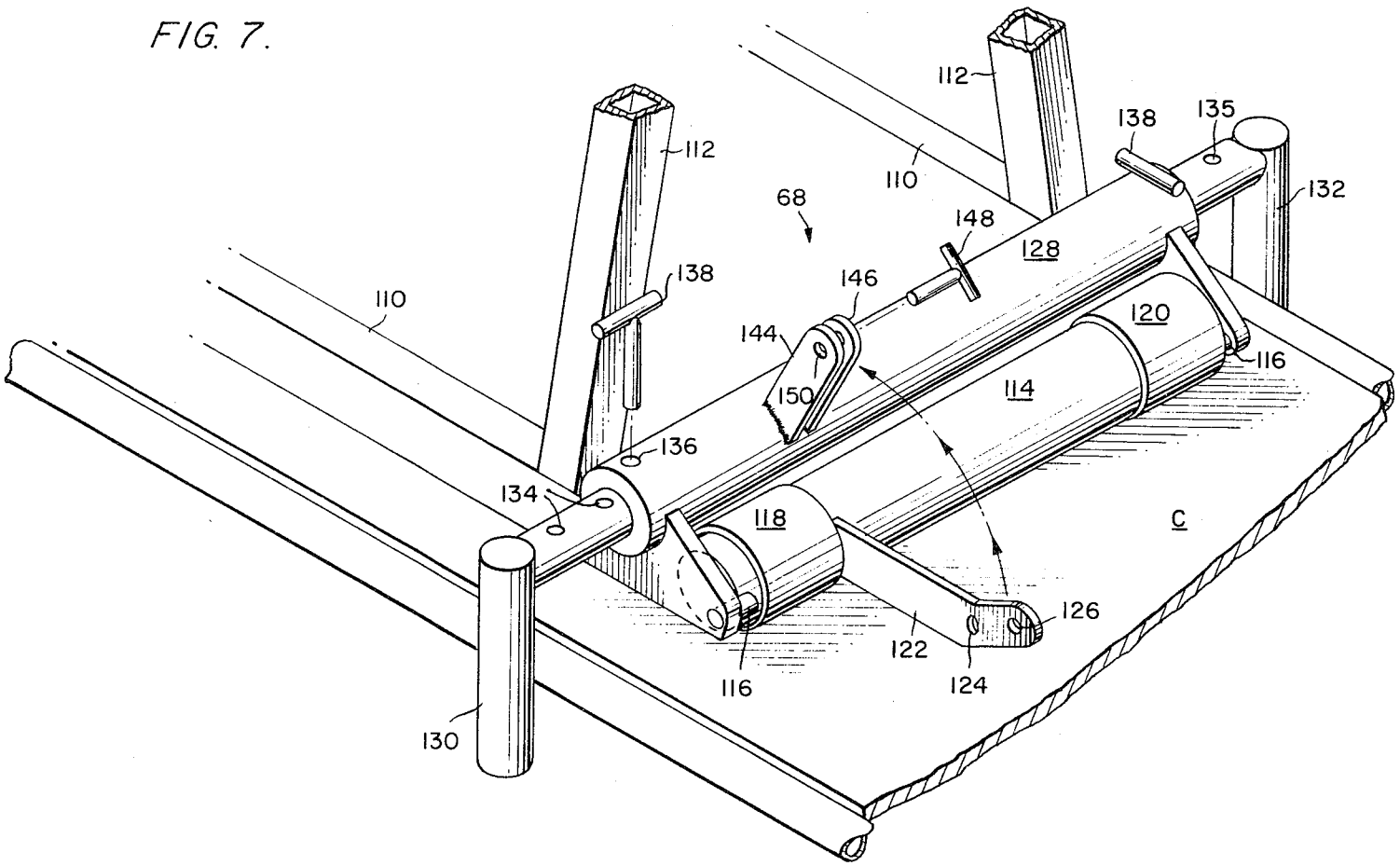
FIG. 7 is a perspective fragmentary view of the frame roller of the machine of FIG. 1 illustrated in a partially exploded view.

Frame roller mechanism 68 is best shown in FIG. 7. Referring thereto, it is seen that mechanism 68 is attached to horizontal frame members 110, 110 and vertical frame members 112, 112. Lift roller 114 is positioned between the forward portions of frame members 110, 110 and includes roller pins 116, 116 secured to the outside at the end portions thereof. Pins 116 are rotatably mounted in the forward portion of frame members 110. Roller sleeves 118 and 120, while held in place along the longitudinal axis of lift roller 114, are free to rotate about that axis. Lift bar 122 having holes 124 and 126 at its outer edge is welded to roller 114. Guide bar 128 includes right angle guide members 130 and 132 which slide freely inside bar 128 and include holes 134 and 135 which can be aligned with holes 136 in roller 128 and locking pins 138 inserted therein. Thus, roller mechanism 68 can be adjusted to accommodate different widths of catwalk C and to guide machine 30 as it is being rolled along catwalk C.

Figure 8:
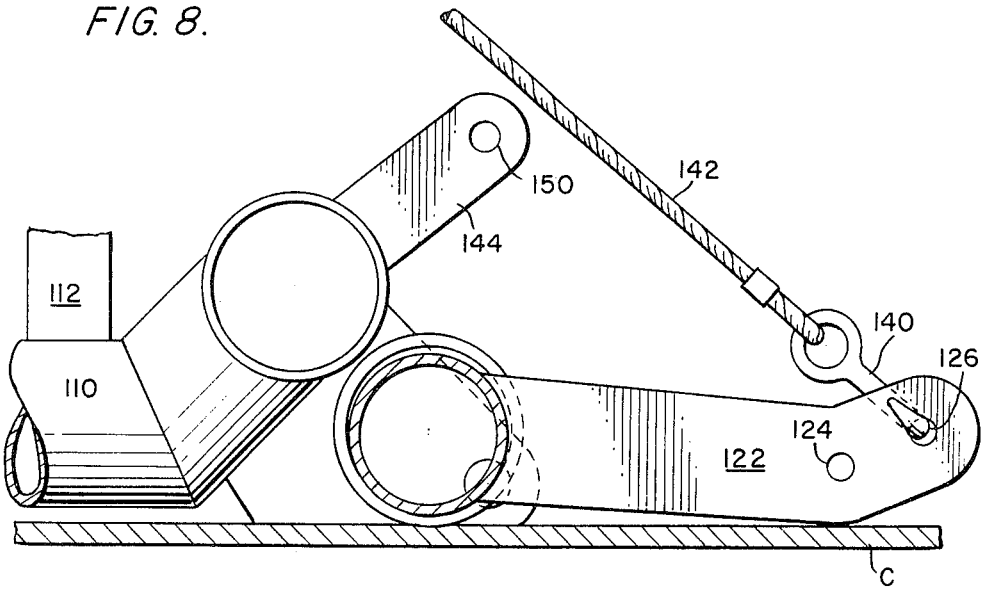
FIG. 8 is a side elevational view of the frame roller of FIG. 7.
Figure 9:
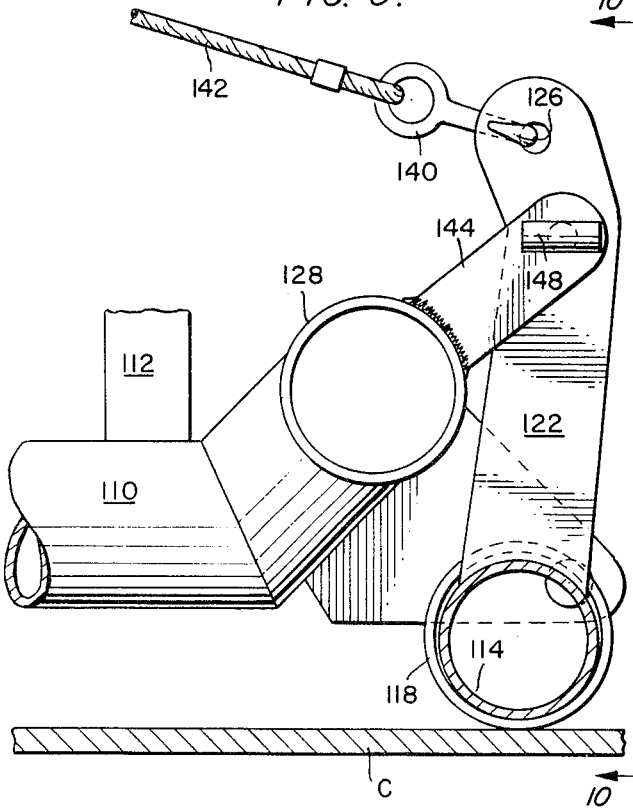
FIG. 9 is a view similar to FIG. 8 illustrating the frame roller in a lifted position.
Figure 10:
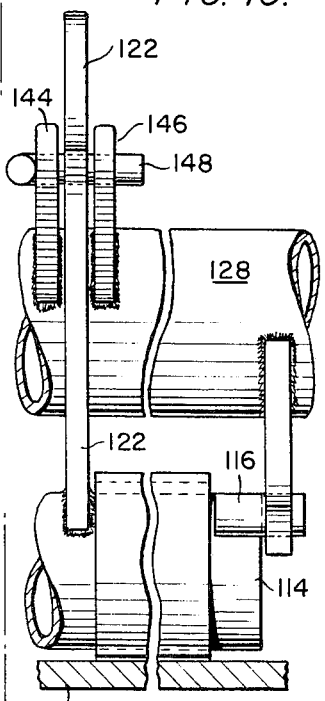
FIG. 10 is a fragmentary cross-sectional view taken along line 10—10 of FIG. 9.

A hook 140 can be inserted into hole 126 and pulled by a chain 142, as shown in FIGS. 8 and 9. Chain 142 can be pulled through any conventional means, e.g. a winch means. As the chain pulls member 122 towards bar 128, lift roller 114 rolls about pins 116 in a camming manner. This lifts frame members 110 off of catwalk C as best shown in FIG. 9. A pair of parallel spaced members 144 and 146 are mounted to bar 128 and project therefrom. As cable 142 pulls bar 122 into the space between members 144 and 146 a locking pin 148 can be inserted into the aligned holes 150 of members 144 and 146 as well as hole 124 of bar 122 securing the locking mechanism in the lifted position as illustrated in FIG. 9 and FIG. 10. When in the lifted position, machine 30 can be pushed or pulled along catwalk C, or along the flatbed of a truck, as it rolls freely on rollers 118 and 120. The present invention further contemplates the use of at least two of these mechanisms positioned at opposite ends of the machine and operating in parallel fashion.

A second embodiment of frame roller mechanism 68 is shown in FIGS. 11 through 13. Referring thereto, it is seen that this embodiment operates on the same general principles but has a simpler construction. Roller 152 disposed generally perpendicular to catwalk C has roller sleeves 154 rotatably disposed about it. Pin 156 attached thereto rotates in plate 158 which is welded to horizontal frame member 160. Bar 162 welded to roller 152 has two holes 164 and 166, as best shown in FIG. 12. A hook 168 is hooked into hole 166 and pulled by chain 170. As chain 170 pulls on bar 162 roller 152 rotates via pin 156. This forces horizontal bar 160 into the lifted position, as shown in FIG. 12. When in the fully lifted position, hole 164 is aligned with holes 172 in ears 174, which are mounted to support tube 178. A locking pin 176 is then placed through the registered holes thereby securing bar 162 in the lifted position, illustrated in FIGS. 12 and 13. When in the lifted position, the frame and hence the stationary trough are lifted off of catwalk C and are free to roll on roller sleeves 154 as machine 30 is pushed or pulled along the catwalk or similar support surface.

Figures 14, 15, 16:
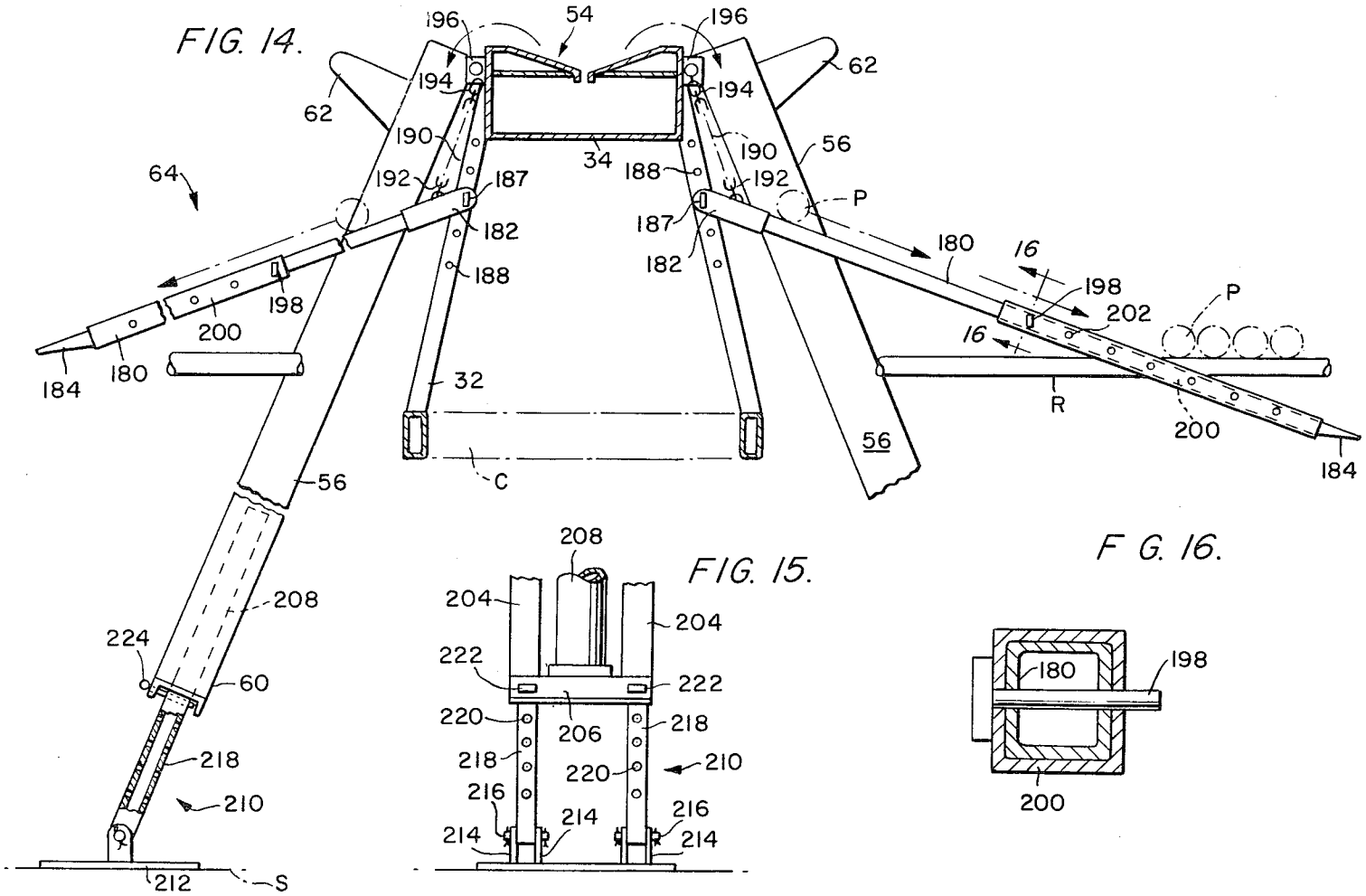
FIG. 14 is a fragmentary, cross-sectional view of the machine of FIG. 1 illustrating in greater detail the pipe racking assembly.
FIG. 15 is a fragmentary, elevational view of the feet of the racking arms of FIG. 14.
FIG. 16 is a cross-sectional view taken along line 16—16 of FIG. 14.

FIG. 14 illustrates the movement of the pipe laterally from the stationary trough to the pipe racks R. Dump trough portion 54 of the stationary trough causes the pipe to move laterally to the lugs 62 of pipe racking arms 56. Referring to FIG. 1, as lugs 62 move down racking arms 56 pipe P is caught by the run off arm assemblies 64. Run off arm assembly 64 is adjustable, as will be more fully described later, to place pipe P at preselected locations on pipe rack R. Run off arm assemblies 64 are positioned on either side of the stationary trough. Each assembly generally comprises a pair of parallel arms 180 having upper ends 182 and lower ends 184. Arms 180 are attached to the frame at locations between the racking arms, but it is also within the scope of the present invention to attach them outside of the racking arms but they must be close enough to hold lengths of pipe between them. As best illustrated in FIG. 14, arms 180 are pivotally attached by locking pin 186 placed in hole 188 of frame 32 and through a hole in upper end 182. A plurality of holes 188 are provided to allow for the adjustment of end 182 relative to the frame and thus to the pipe rack. Arm 180 is held at a desired angle by chain 190 which is secured at its lower end 192 to arm 180 at a location spaced a distance from end 182 and at its other end 194 to ear 196 attached to the side of the stationary trough. It is within the scope of the present invention to provide for chains of variable length or a set of chains each having different lengths from which the desired ones are chosen. Thus, the machine operator can vary the run off of the pipe by adjusting the location of end 182 relative to the frame by selecting a different hole 188 therein and also by selecting a different length of chain 190. He may also adjust the length of arm 180 by removing pin 198 and sliding outer arm 200 relative to arm 180 until a different set of holes 202 are aligned and then reinserting pin 198. This length adjustment means is best illustrated in FIG. 16.

Racking arms 56 are also provided with a length adjustment means at their lower ends 60, as best shown in FIGS. 14 and 15. Racking arm lower end 60 includes a pair of tubes 204, 204 mounted to plate 206 on either side of hydraulic cylinder assembly 208. It is assembly 208 which drives the lug 62 along the racking arm. Adjustable foot shown generally at 210 includes a support plate 212 on which two pair of ears 214, 214 are mounted. Ears 214 have holes at their upper ends through which pins 216 may be inserted. Pins 216 are also inserted through holes in the lower ends of rods 218, 218. Rods 218, 218 are adapted to slide through plate 206 and into tubes 204, 204. The rods have a series of holes 220 which can be adjustably aligned with holes 222, 222 in tubes 204, 204 and pins 224 inserted therethrough. Thus, the length of the racking arms may be adjusted by sliding rods 218 in tubes 204 and locking them in the desired position by pins 224. It is also seen that the pivotal connection of rods 218 to plate 212 allows for a firm contact of the racking arm to support surface S for varying lengths of arm 56.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. A machine for transferring pipe between the floor of a drilling rig and pipe rack means comprising:

a stationary trough means adapted to be located below the level of the drilling rig floor, said stationary trough means having a first end, an opposite second end and a stationary trough means pipe support surface, said second end extending towards the rig and positionable close to the rig, a support means positioned at said second end of said stationary trough means, a movable trough means for receiving and supporting pipe having a lower end and an opposite upper end, said movable trough means being aligned with said stationary trough means, said lower end being coupled to said support means for generally vertical movement between a lower position and an upper position, said lower position being next to and above said second end of said stationary trough means and said upper position being at a level above and spaced from said second end of said stationary trough means, said upper end of said movable trough means being adapted to be supported by the floor of the rig, a movable means supported for movement along the length of said stationary trough means for moving pipe lengthwise along said stationary trough means, a lower end moving means operatively connected to said lower end of said movable trough means for moving said lower end between said lower and upper positions, and an operator's cab attached to and supported by said first end of said stationary trough means, said operator's cab including a platform having one end attached to said first end of said stationary trough means and an opposite end extending away from said first and second ends of said stationary trough means, said platform having a floor spaced below said stationary trough means pipe support surface, said operator's cab including an operator's station positioned on said platform, a housing supported on said platform, and an attaching means for pivotally attaching said housing relative to said first end so that said housing can pivot between a first position upright and generally over said operator's station and a second position pivoted generally 90° from said first position towards said first end such that said housing rests on its side on said stationary trough means, said operator's station including an upright control panel operatively connected to said movable means and to said first end moving means for controlling said movable means and said first end moving means and adapted and positioned to remain upright as said housing is pivoted between said first position and said second position, and said housing including a pair of spaced panels positioned to be adjacent and on opposite sides of said stationary trough means when said housing is in said second position.

2. The machine of claim 1 including, said connecting means including at least one connecting hose at least a portion of which adjacent said control panel comprises nonflexible material.

3. The machine of claim 1 including, said attaching means comprising a pipe and pin hinge mechanism.

4. The machine of claim 1 including, said attaching means being connected to said first end and to said platform one end.

5. A machine for transferring pipe between the floor of a drilling rig and pipe rack means comprising:

a stationary trough means adapted to be located below the level of the drilling rig floor, said stationary trough means having a first end and an opposite second end, said second end extending towards the rig and positionable close to the rig, a support means positioned at said second end of said stationary trough means, a movable trough means for receiving and supporting pipe having a lower end and an opposite upper end, said movable trough means being aligned with said stationary trough means, said lower end being coupled to said support means for generally vertical movement between a lower position and an upper position, said lower position being next to and above said second end of said stationary trough means and said upper position being at a level above and spaced from said second end of said stationary trough means, said upper end of said movable trough means being adapted to be supported by the floor of the rig, a movable means supported for movement along the length of said stationary trough means for moving pipe lengthwise along said stationary trough means, a lower end moving means operatively connected to said lower end of said movable trough means for moving said lower end between said lower and upper positions, said stationary trough means being positionable on a catwalk adjacent the rig, a lifting means for lifting said stationary trough means off of the catwalk, and a rolling means associated with said lifting means for rolling said lifted stationary trough means on the catwalk, said rolling means including a frame mounted to said stationary trough means, a roller mounted to said frame for rotation about a longitudinal axis of said roller spaced from the center longitudinal axis of said roller, and a sleeve rotatably disposed about said roller, and said lifting means including a means for rotating said roller about said longitudinal axis causing said frame and said stationary trough means to lift off of the catwalk and be supported on said roller sleeve.

6. The machine of claim 5 including, a securing means for securing said roller in a rotated position when said frame is in a lifted position.

7. The machine of claim 5 including, said longitudinal axis being disposed perpendicular to the longitudinal centerline of the catwalk.

8. The machine of claim 5 including, a guiding means associated with said rolling means for guiding said stationary trough means along the catwalk, said guiding means engaging the sides of the catwalk.

9. The machine of claim 8 including, said guiding means being attached to opposite ends of said roller.

10. The machine of claim 5 including, said rotating means comprising at least one bar mounted to and projecting from said roller, and a pulling means connected to said bar for pulling said bar and thereby rotating said roller.

11. A machine for transferring pipe between the floor of a drilling rig and pipe rack means comprising:

a stationary trough means adapted to be located below the level of the drilling rig floor, said stationary trough means having a first end and an opposite second end, said second end extending towards the rig and positionable close to the rig, a support means positioned at said second end of said stationary trough means, a movable trough means for receiving and supporting pipe having a lower end and an opposite upper end, said movable trough means being aligned with said stationary trough means, said lower end being coupled to said support means for generally vertical movement between a lower position and an upper position, said lower position being next to and above said second end of said stationary trough means and said upper position being at a level above and spaced from said second end of said stationary trough means, said upper end of said movable trough means being adapted to be supported by the floor of the rig, a movable means supported for movement along the length of said stationary trough means for moving pipe lengthwise along said stationary trough means, a lower end moving means operatively connected to said lower end of said movable trough means for moving said lower end between said lower and upper positions, said stationary trough means being positionable on a catwalk adjacent the rig, a lift camming means for lifting said stationary trough means off of the catwalk, a rolling means associated with said lift camming means for rolling said lifted stationary trough means on the catwalk, and a guiding means attached to said rolling means and engaging the sides of the catwalk for guiding said stationary trough means along the catwalk, and adjustable to accommodate different catwalk widths.

12. A machine for transferring pipe between the floor of a drilling rig and pipe rack means comprising:

stationary trough means adapted to be located below the level of the drilling rig floor, said stationary trough means having a first end and an opposite second end, said second end extending towards the rig and positionable close to the rig, a support means positioned at said second end of said stationary trough means, a movable trough means for receiving and supporting pipe having a lower end and an opposite upper end, said movable trough means being aligned with said stationary trough means, said lower end being coupled to said support means for generally vertical movement between a lower position and an upper position, said lower position being next to and above said second end of said stationary trough means and said upper position being at a level above and spaced from said second end of said stationary trough means, said upper end of said movable trough means being adapted to be supported by the floor of the rig, a movable means supported for movement along the length of said stationary trough means for moving pipe lengthwise along said stationary trough means, a lower end moving means operatively connected to said lower end of movable trough means for moving said lower end between said lower and upper positions, and a racking means for moving pipe laterally between said stationary trough means and a pipe rack means positioned adjacent said stationary trough means, said racking means including a leg means pivotally secured at one end to said stationary trough means and having an opposite end adapted to rest on a support surface adjacent said pipe rack means, a pipe cradling lug means connected to said leg means and a power means for moving said lug means along said leg means, said power means including a hydraulic cylinder positioned in said leg means, said leg means including a pair of parallel tubes positioned on opposite sides of and parallel to said hydraulic cylinder, and an adjustable foot assembly connected to said pair of parallel tubes, said adjustable foot assembly including a rotatable support plate having a plate ground contact surface, a pair of spaced ears mounted to said rotatable support plate, a pair of spaced parallel rods pivotally connected at one end to one said ear and having a second end adapted to slide in one said tube, each said rod and said tube having a series of registerable openings, and a pin means insertable in said registerable openings for securing said rotatable support plate at the desired distance relative to the lower end of said hydraulic cylinder.

13. The machine of claim 12 including, a ramp bar means having a first bar end and a second bar end for guiding pipe from said pipe cradling lug means down to different positions in said pipe rack means, a pivotal attaching means for pivotally attaching said first bar end at a pivotal attachment point to said stationary trough means, and an adjustable chain means for securing said ramp bar means at selectively more than one angle relative to said stationary trough means, said adjustable chain means having a chain end attached to said stationary trough means and an opposite chain end attached to said ramp bar means, at an attachment location spaced from said pivotal attachment point, towards said second bar end.

14. The machine of claim 13 including, said ramp bar means including a telescoping length adjustment means for selectively adjusting the distance between said first and second bar ends.

* * * * *